US005778778A

United States Patent [19]

Chiloff

[11] Patent Number: 5,778,778

[45] Date of Patent: Jul. 14, 1998

[54] DEVICE FOR ALIGNING A WEB USED IN A PRINTING ROTARY MACHINE

[75] Inventor: Serge Chiloff, Loiret, France

[73] Assignee: Societe d'Etude de Machines pour les Arts Graphiques, Olivet, France

[21] Appl. No.: 757,686

[22] Filed: Nov. 29, 1996

[51] Int. Cl.[6] ..... B41F 5/06; B41F 13/02

[52] U.S. Cl. ..... 101/181; 101/228

[58] Field of Search ..... 101/228, 181, 101/183, 220, 138, 139, 227, 229, 230, 221, 222, 223, 224, 225, 178, 179, 180, 143; 226/18, 19, 21, 197, 199, 24

[56] References Cited

U.S. PATENT DOCUMENTS 5,174,096 12/1992 Fukuda ..... 226/19
5,357,859 10/1994 Eckert ..... 101/228

*Primary Examiner*—J. Reed Fisher
*Attorney, Agent, or Firm*—Browdy and Neimark

[57] ABSTRACT

The exit cylinder of a first unit is connected to the entrance cylinder of a second unit for making a deformable parallelogram, and at least the exit and entrance cylinders of each unit are respectively connected to displacement mechanisms.

15 Claims, 4 Drawing Sheets

DEVICE FOR ALIGNING A WEB USED IN A PRINTING ROTARY MACHINE

FIELD AND PURPOSE OF THE INVENTION

This invention has for purpose, while making very easy an aligning of a machine working on the moving of a web material, which machine includes a plurality of successive working units, to simplify the construction thereof and to group, in a single mechanism, three functions that are generally separated : alignment, longitudinal registering and side registering. These functions are particularly important for printing machines, more particularly rotary press machines.

In a rotary machine, for example, a helio rotary machine, that prints a web material, when the same runs from one cylinder to another and when these two cylinders are not perfectly parallel, the exterior fibers of the web are not stretched with same stress and, therefore, are not balanced.

This un-balancing results in lateral movements of the web material, making it impossible to maintain a registering stability between the colors that are successively printed. To avoid such un-balance, it is compulsory to obtain a perfect alignment of the printing units, which is obtained after a careful leveling and paralleling work.

Unfortunately, the success of the above work is not always verified in actual pratice, because:

on the one hand, of pilings and size margins in the construction of the unit and of the drying thereof;

on the other hand, of the mobility of some grounds on which are mounted the machines, which makes that a machine, perfectly aligned upon its setting up, is no more aligned after some time.

It is thus necessary to ensure in any case that the exit cylinder of a preceding unit is parallel to the cylinder of the following unit. These two cylinders should not necessarily be in the same plane. Actually, if there is a small angle between their axes in a projection on a plane parallel to the two cylinders, the web of material will easily find a balanced position, in such a manner that the exterior fibers will be stretched with same stress. It is obvious, in this case, that stretching of the exterior fibers will be stronger than stretching of the median fiber.

The stretching difference will more specially be as greater as the angle projected on a plane that is parallel to the two cylinders will be large.

However, if the projected angle can be considered as an infinitely small angle of the first order, the difference between the exterior stretching and the median stretching will be an infinitely small angle of the second order. This means that, for small spacing angles, still assuming that the two cylinders are parallel, the stretching difference between the exterior and median fibers is negligible.

This principle is well known to rotary machine manufacturers. It is in particular used with success in web guiding mechanisms.

BACKGROUND OF THE INVENTION

In an helio rotary machine, the lateral registering function between colors is generally obtained by an axial displacement of the engraved cylinders. This leads to complex mechanisms, with, as an additional drawback, that an axially movable cylinder will be not so rigid in space as a cylinder that is mounted fixedly with respect to the frame.

To overcome this drawback, some manufacturers have chosen to laterally displace the entire unit on the bedplate therof, similar to a table of a machine tool. It is in this case obvious that, although the engraved cylinder is fixedly connected to the frame, the whole unit has a lesser stability than if it were fixedly secured to the ground.

The longitudinal registering function is generally obtained by means of a movable guide cylinder, that is called a register. The mechanism of the register is integrated to the unit, and the movement of the cylinder can be either manual or motorized. In the latter case, it is possible to make the registering to be an automatic registering by means of an electronic servo-mechanism.

This system has the drawback, on the one hand, to lengthen the web between two units and consequently to increase the time constant of the system and, on the other hand, to cause a variation in the length of the web in the machine, following the corrections, which results in un-necessarily modifying the color registering that follows the one which has just been corrected.

To overcome these drawbacks, some manufacturers have chosen to make the longitudinal registering by means of a transmission by differential of the control to the engraved cylinder. This mechanism cancels entirely the two above mentioned draw-backs, but introduces some plays in the transmission members, which can be detrimental to the registering stability.

Finally and despite these drawbacks, registering by means of a register is very often preferred to registering by means of a differential.

In the system according to the claimed invention, the three functions on which the stability and preciseness of an helio rotary machine are based, are grouped in a very simple single mechanism.

With this system, the printing units can be fixedly secured to the ground, the engraved cylinders can be rigidly mounted between the frames of the machine, the play in the transmission can be reduced to a minimum, and the length of the web can be as short as in a machine in which the registering is made by means of a differential.

This leads in comparison to conventional machines, to a construction which is more economical and stronger, and to a more precise final result.

SUMMARY OF THE INVENTION

According to the invention, the device for aligning a web used in a printing rotary machine comprising at least two printing units, each provided with an entrance cylinder and an exit cylinder for the web, is characterized in that the exit cylinder of a first unit is connected to the entrance cylinder of a second unit for a deformable parallelogram, and in that at least the exit and entrance cylinders of each unit are respectively connected to displacement mechanisms.

An embodiment of the invention is shown, as a non limitative example, in the accompanying drawings.

Various other features of the invention will moreover be revealed from the following detailled disclosure.

DESCRIPTION OF THE DRAWINGS

Figure 1:
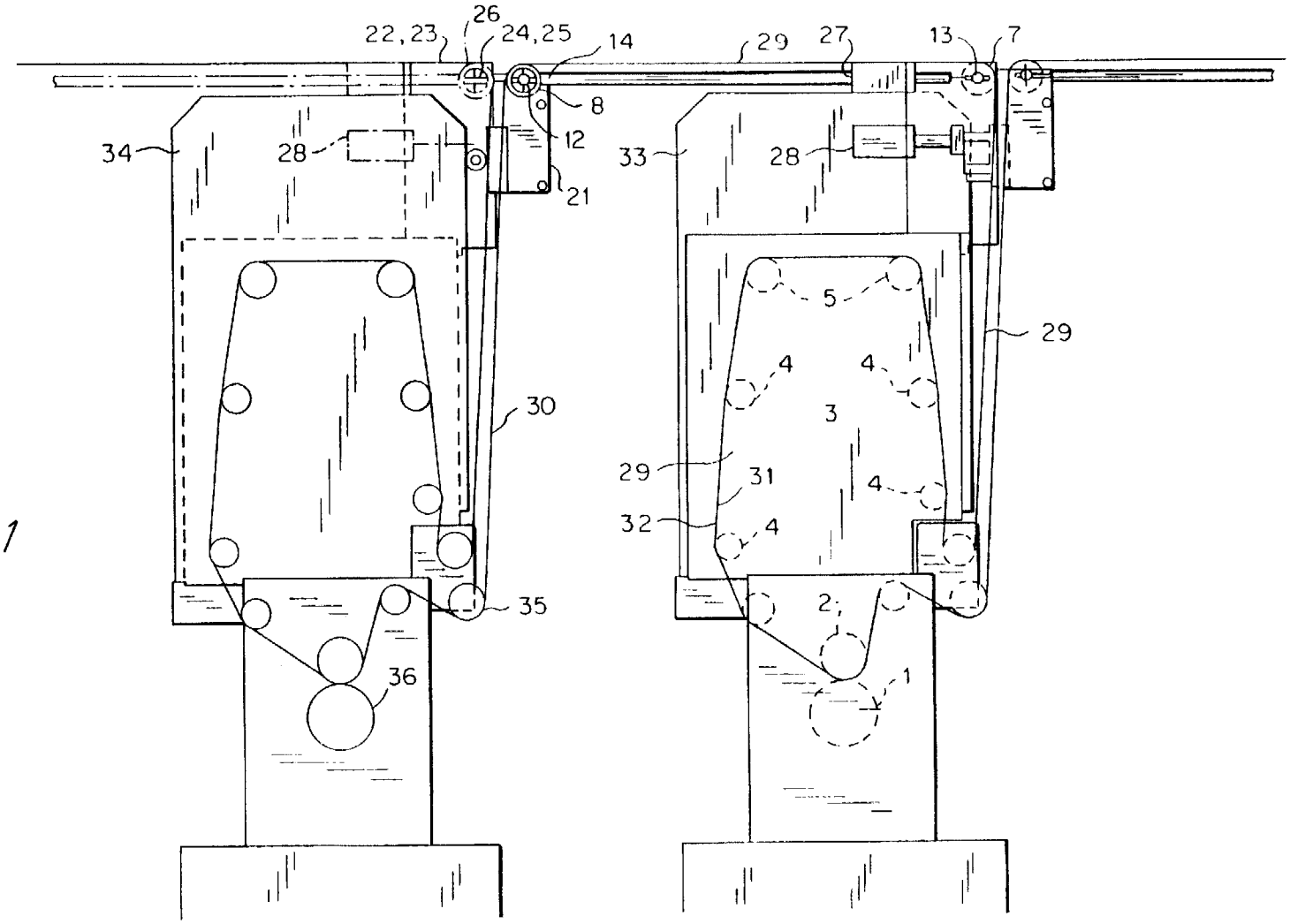
FIG. 1 is a diagrammatic elevation view of the device of the invention embodied in an assembly of two printing units.

The web 29 leaving the engraved cylinder 1, after it has been printed by pressure of the cylinder 2, passes in a dryer 3 in which the web is rolled round guide cylinders 4 and 5 for supporting it on the non printed surface 31, while hot air is blown on the surface 32 which has just been printed.

The web 29 runs out of the dryer 3 by rolling round the cylinder 6 and leaves the unit 33 via the cylinder 7. The web 29 then enters the following unit 34 via the cylinder 8 and follows in this unit 34 a path which is identical to that followed in the preceding unit 33.

Figure 2:
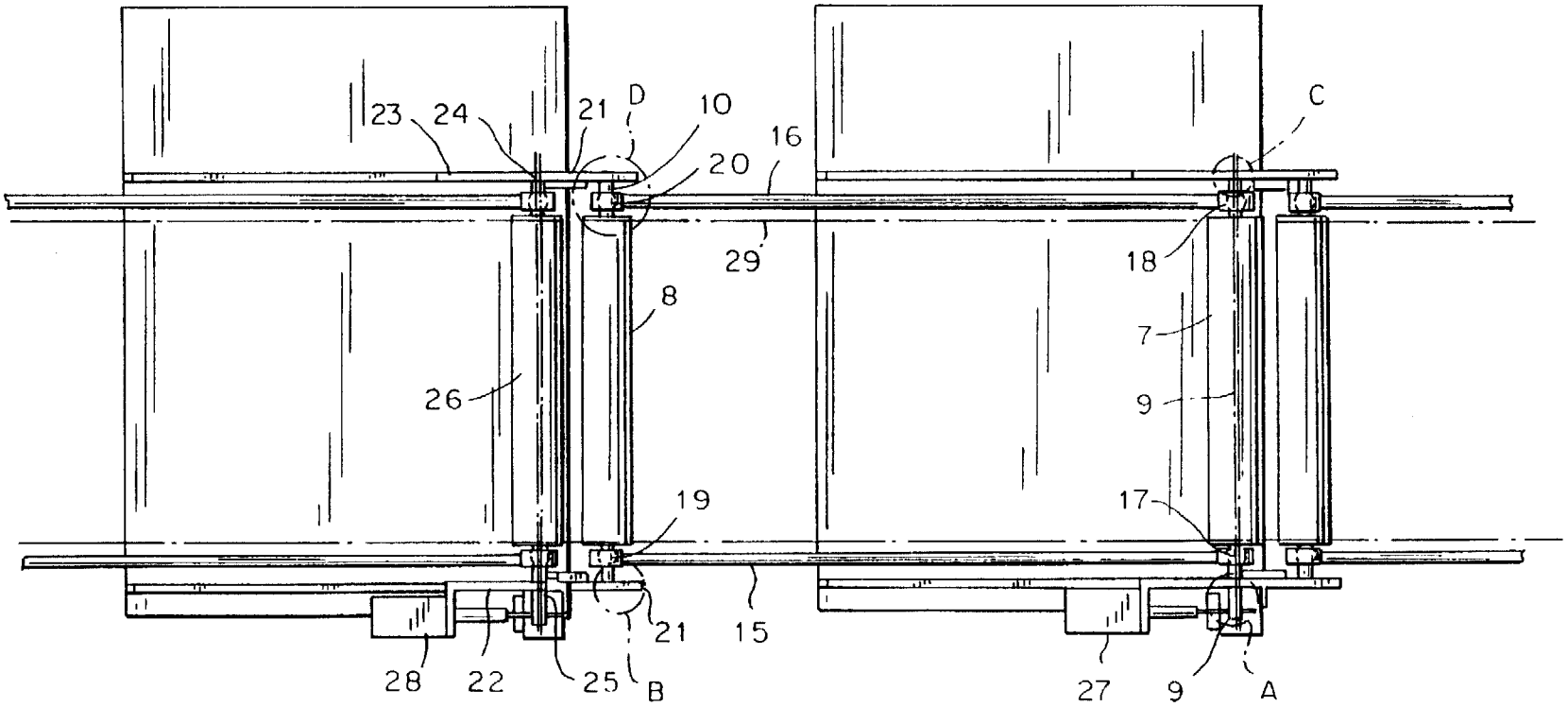
FIG. 2 is a top plan view corresponding to FIG. 1.
Figure 2A:
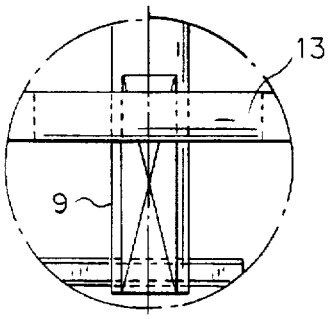
FIGS. 2A to 2D are partial enlarged views of the parts respectively encircled in A, B, C and D in FIG. 2.
Figure 2B:
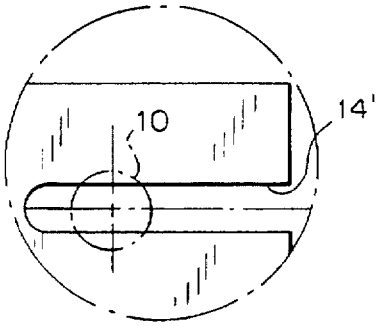

FIG. 2 is a top view that shows the cylinders 7 and 8. These cylinders rotate freely on their shafts 9 and 10; they can be moved in an horizontal plane by pivoting around vertical pivot member 11 (FIG. 2C) and a sliding vertical pivot member 12 (FIG. 2D), and by sliding in guides or slides 13, 14 and 14', that can be seen in FIGS. 1, 2A, 2B and 2D. The shafts 9 and 10 are connected together by means of rods 15 and 16 that have rigorously identical lengths. The rods 15 and 16 are pivotably connected to the shafts 9 and 10 by means of swivel joints 17, 18, 19 and 20.

Figure 2D:
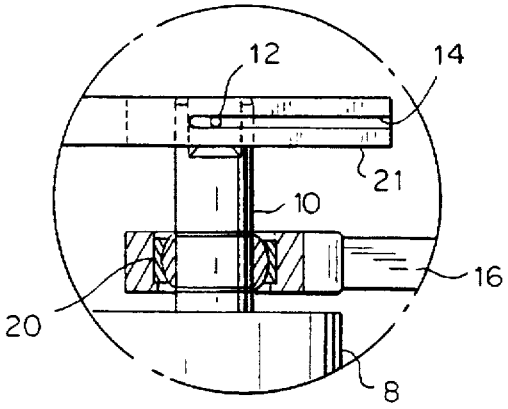
Figure 2C:
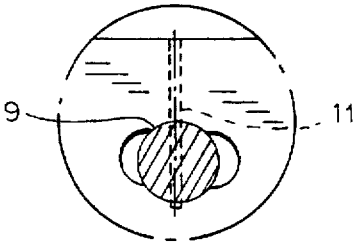

In FIGS. 2 and 2D, the pivot member 12 and the slide 14 are mounted on a support assembly 21 shown in FIG. 1, which moves vertically relative to supports 22 and 23. The supports 22 and 23 carry the pivot member 24 and slide 25 of the cylinder 26, which are identical to the pivot member 11 and slide 13 of cylinder 7. The web 29 leaves the second unit 34 by means of cylinder 26.

The horizontal displacement of the cylinder 7 can be made by means of a flywheel or a servo-motor 27 (FIG. 1). The vertical displacement of the support assembly 21 can be made by means of a flywheel or a servo-motor 28 (FIG. 1).

The two servo-motors 27 and 28 are illustrated on the front part of the units 33,34, on the side of the operator, but they can as well be mounted on the opposite side, without modifying the working description. In this case, the figures would be symmetrical.

In FIG. 2, the assembly made of the cylinders 7 and 8 and rods 15 and 16 forms a deformable parallelogram due to the use of swivel joints 17–20. In the case of FIG. 2, this parallelogram is a rectangle and the web of material 29, that leaves the cylinder 7 according to an axis that is perpendicular thereto, is brought to the cylinder 8 also according to an axis that is perpendicular to the latter.

Assuming that the two units 33,34 are at a perfectly horizontal level and parallel therebetween, the web 29 will follow in the case of the figure a path that is without stress and perfectly centered with respect to the two units 33,34.

Figure 3:
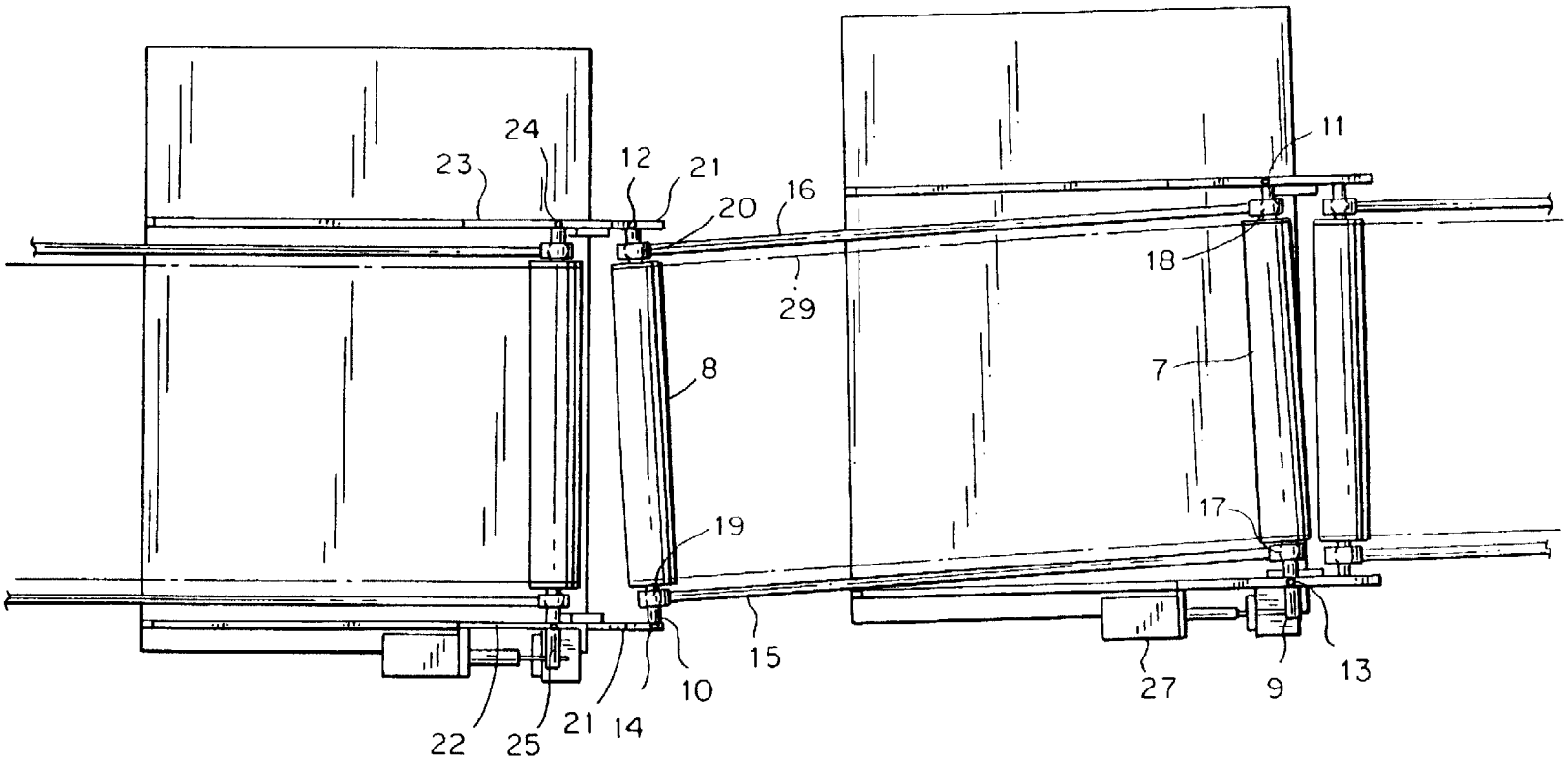
FIG. 3 is a top plan view similar to FIG. 2 and illustrating characteristic positions of the printing units.

Assuming now that the two units 33,34 are not perfectly horizontal and neither perfectly at a same level nor perfectly parallel, as this is often the case in current practice and as shown in FIG. 3, it is still possible, by horizontally displacing the cylinder 7, to find an angle that the web 29 when leaving the first unit 33 in the median axis of the cylinder 7, will be brought to the cylinder 8 also according to its median axis. It should be noted in this case that the distance between the two units 33,34 can be different from that of FIG. 1 without this resulting in a stress on the rod 16 thanks to the sliding movement of the pivot member 12. The path of the web will be done with no more stress thereupon than if the two units were perfectly aligned since the web 29 connects two cylinders 7 and 8 that are parallel, though they are not perfectly located in a same plane, and since the part 30 of the web 29 connects two cylinders 8 and 35 of the second unit that are parallel by construction.

The alignment of a machine can thus be done much more rapidly and with tolerances that are much freer than those which are in general necessary. Moreover, this alignment can be done without any major care for possible displacements of the units in the future due to movements of the ground for example since, whatever it may happen, the path of the web thanks to the ensured parallelism of the cylinders 7 and 8, on the first hand, and 8 and 35, on the other hand, will always be without any stress. It will only suffice to horizontally displace the cylinder 7 to bring the web 29 of material back in the median axis of the second unit 34. Whereas, in a conventional rotary printing machine, it would be necessary to proceed with a new alignment.

This same horizontal movement of the cylinder 7 can be used for moving the web 29, that has been printed by a first unit 33, in the following unit 34 and, consequently, to adjust the lateral color registering without it being necessary to axially displace either the engraved cylinder 36 or the assembly of the second printing unit. In this case, the assembly of the cylinders 7 and 8 and rods 15 and 16 will be deformed in parallelogram without the web 29 being stressed since the two cylinders 7 and 8 remain always parallel.

Samely, a small angular upward or downward displacement of the rods 15 and 16 by means of the servo-motor 28 will lengthen or shorten the web section between the engraved cylinders 1 and 36 and, consequently, will enable adjusting the longitudinal registering between the printed colors.

In this case, passing of the web 29 is direct as in a unit in which the registering is set by means of a differential but does not have the drawback of the additional winding and lengthening that is encountered with a register integrated with the unit.

In the above description, the invention is disclosed in relation to an assembly of two units that print according to heliogravure process. It is obvious that this number of two units is not restrictive, and that another number of printing units can be aligned for making a rotary printing machine. Samely the above description is not restricted to heliogravure process. It can be applied to any other process that uses a similar passing of a web and that works by successive steps on the running of the web.

The invention is not restricted to the embodiments that have been shown and described in detail since various modifications thereof can be applied thereto without departing from its scope.

I claim:

1. A device for aligning a web used in a printing rotary machine having at least two printing units, each of said two printing units comprising an entrance cylinder and an exit cylinder for the web; wherein the exit cylinder (7) of a first unit of said two printing units is pivotably connected in a horizontal plane to the entrance cylinder (8) of a second unit of said two printing units by a pair of rods forming a deformable parallelogram, wherein at least the exit cylinder of said first unit (7) and the entrance cylinder (8) of said second unit are respectively connected to displacement means for adjustment relative to said first unit and said second unit (27, 21, 28).

2. A device as set forth in claim 1, wherein said displacement means are respectively provided for horizontal displacement (27) and for vertical displacement (21, 28).

3. A device as set forth in claim 2, wherein said displacement means for horizontal displacement (27) actuates the exit cylinder (7) of said first unit, and said displacement means for vertical displacement (21, 28) actuates the entrance cylinder (8) of said second unit.

4. A device as set forth in claim 3, wherein said pair of rods (15, 16) are of identical length and are pivotably connected to respective ends of the exit cylinder (7) and the entrance cylinder (8).

5. A device as set forth in claim 4, wherein the pair of rods (15, 16) are respectively connected to the exit cylinder (7) and entrance cylinder (8) by means of shafts (9, 10) each end of which is pivotably mounted to respective ends of said pair of rods by a swivel joint (17, 18, 19, 20).

6. A device as set forth in claim 5, wherein said displacement means comprises a fixed pivot member (11) provided at one end of the exit cylinder (7) and a slide (13) at the other end, a slidable pivot member (12) at one end of the entrance cylinder (8), a slide (14) at the other end and servo-mechanisms to actuate movement, the fixed pivot member and the slidable pivot member being arranged on a side opposite to the servo-mechanisms.

7. A device as set forth in claim 2, wherein said pair of rods (15, 16) are of identical length and are pivotably connected to respective ends of the exit cylinder (7) and the entrance cylinder (8).

8. A device as set forth in claim 3, wherein the pair of rods (15, 16) are respectively connected to the exit cylinder (7) and entrance cylinder (8) by means of shafts (9, 10) each end of which is pivotably mounted to respective ends of said pair of rods by a swivel joint (17, 18, 19, 20).

9. A device as set forth in claim 8, wherein said displacement means comprises a fixed pivot member (11) provided at one end of the exit cylinder (7) and a slide (13) at the other end, a slidable pivot member (12) at one end of the entrance cylinder (8), a slide (14) at the other end and servo-mechanisms to actuate movement, the fixed pivot member and the slidable pivot member being arranged on a side opposite to the servo-mechanisms.

10. A device as set forth in claim 1, wherein said pair of rods (15, 16) are of identical length and are pivotably connected to respective ends of the exit cylinder (7) and the entrance cylinder (8).

11. A device as set forth in claim 10, wherein the pair of rods (15, 16) are respectively connected to the exit cylinder (7) and entrance cylinder (8) by means of shafts (9, 10) each end of which is pivotably mounted to respective ends of said pair of rods by a swivel joint (17, 18, 19, 20).

12. A device as set forth in claim 11, wherein said displacement means comprises a fixed pivot member (11) provided at one end of the exit cylinder (7) and a slide (13) at the other end, a slidable pivot member (12) at one end of the entrance cylinder (8), a slide (14) at the other end and servo-mechanisms to actuate movement, the fixed pivot member and the slidable pivot member being arranged on a side opposite to the servo-mechanisms.

13. A device as set forth in claim 1, wherein the pair of rods (15, 16) are respectively connected to the exit cylinder (7) and entrance cylinder (8) by means of shafts (9, 10) each end of which is pivotably mounted to respective ends of said pair of rods by a swivel joint (17, 18, 19, 20).

14. A device as set forth in claim 1, wherein said displacement means comprises a fixed pivot member (11) provided at one end of the exit cylinder (7) and a slide (13) at the other end, a slidable pivot member (12) at one end of the entrance cylinder (8), a slide (14) at the other end and servo-mechanisms to actuate movement, the fixed pivot member and the slidable pivot member being arranged on a side opposite to the servo-mechanisms.

15. A device as set forth in claim 13, wherein said displacement means comprises a fixed pivot member (11) provided at one end of the exit cylinder (7) and a slide (13) at the other end, a slidable pivot member (12) at one end of the entrance cylinder (8), a slide (14) at the other end and servo-mechanisms to actuate movement, the fixed pivot member and the slidable pivot member being arranged on a side opposite to the servo-mechanisms.

* * * * *